US010770255B2

(12) United States Patent
Juelich et al.

(10) Patent No.: US 10,770,255 B2
(45) Date of Patent: Sep. 8, 2020

(54) SELF-RESETTING CURRENT LIMITER

(71) Applicant: Eaton Electrical IP GmbH & Co. KG, Schoenefeld (DE)

(72) Inventors: Anke Juelich, Niederkassel (DE); Klaus Dauer, Koblenz (DE); Volker Lang, Bonn (DE); Guenter Baujan, Troisdorf (DE); Hartwig Stammberger, Alfter (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/841,349

(22) Filed: Dec. 14, 2017

(65) Prior Publication Data

US 2018/0174789 A1 Jun. 21, 2018

(30) Foreign Application Priority Data

Dec. 16, 2016 (DE) ..... 10 2016 124 639

(51) Int. Cl.
*H01H 71/24* (2006.01)
*H01H 71/43* (2006.01)
(Continued)

(52) U.S. Cl.
CPC ..... *H01H 71/24* (2013.01); *H01H 71/43* (2013.01); *H01H 71/462* (2013.01);
(Continued)

(58) Field of Classification Search
CPC .... H01H 77/104; H01H 1/226; H01H 71/501; H01H 71/525; H01H 3/30; H01H 3/3031;
(Continued)

(56) References Cited

U.S. PATENT DOCUMENTS 3,703,694 A * 11/1972 Bullock ..... H01H 71/161 337/62
2005/0264388 A1* 12/2005 Mueller ..... H01H 71/0257 335/202

(Continued)

FOREIGN PATENT DOCUMENTS

AT 315284 B 5/1974
DE 19701311 A1 7/1998

*Primary Examiner* — Ahmed M Saeed
(74) *Attorney, Agent, or Firm* — Leydig, Voit & Mayer, Ltd.

(57) ABSTRACT

A self-resetting current limiter includes: a first connecting contact for bringing the current limiter into contact with a first electrical conductor a second connecting contact for bringing the current limiter into contact with a second electrical conductor; a first movable contact member; and a second movable contact member, wherein the first and the second movable contact members are electrically interconnected in a first position of the first and the second movable contact member, such that a current path between the first and the second connecting contact is closed, and wherein the first and the second movable contact members are separated from one another in a second position of the first and the second movable contact member, such that the current path between the first and the second connecting contact is interrupted.

13 Claims, 10 Drawing Sheets

(51) Int. Cl.
*H01H 71/02* (2006.01)
*H01H 71/46* (2006.01)
*H01H 9/36* (2006.01)

(52) U.S. Cl.
CPC ..... *H01H 2009/365* (2013.01); *H01H 2071/0278* (2013.01); *H01H 2205/002* (2013.01); *H01H 2235/01* (2013.01)

(58) Field of Classification Search
CPC .. H01H 71/505; H01H 71/526; H01H 1/5822; H01H 71/24; H01H 71/43; H01H 2071/0278; H01H 71/462; H01H 2009/365; H01H 2205/002; H01H 2235/01
USPC ..... 200/401, 244, 400, 283
See application file for complete search history.

(56) References Cited

U.S. PATENT DOCUMENTS

2007/0241081 A1* 10/2007 Puskar ..... H01H 77/108 218/154
2007/0251809 A1* 11/2007 Handler ..... H01H 1/205 200/410
2015/0060247 A1* 3/2015 Morimoto ..... H01H 1/18 200/335

* cited by examiner

SELF-RESETTING CURRENT LIMITER

CROSS-REFERENCE TO PRIOR APPLICATIONS

Priority is claimed to German Patent Application No. DE 10 2016 124 639.5, filed on Dec. 16, 2016.

FIELD

The invention relates to a self-resetting current limiter for interrupting a current path when a short-circuit current occurs in the current path.

BACKGROUND

A current limiter is usually used together with a switching or basic device, for example a circuit breaker or a protective motor switch, in order to increase the short-circuit breaking capacity of the switching or basic device. The switching device and the current limiter effectively share the switching work for switching off the short-circuit current. In so doing, the current limiter assists the switching device by relieving the switching device of some of the required breaking capacity. The breaking capacity can thus be increased overall. High short-circuit currents, for example currents of up to 150 kA, can be safely switched off by means of an arrangement of this kind consisting of a switching device and a current limiter.

SUMMARY

In an embodiment, the present invention provides a self-resetting current limiter, comprising: a first connecting contact configured to bring the current limiter into contact with a first electrical conductor; a second connecting contact configured to bring the current limiter into contact with a second electrical conductor; a first movable contact member; and a second movable contact member, wherein the first and the second movable contact members are electrically interconnected in a first position of the first and the second movable contact member, such that a current path between the first and the second connecting contact is closed, and wherein the first and the second movable contact members are separated from one another in a second position of the first and the second movable contact member, such that the current path between the first and the second connecting contact is interrupted.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
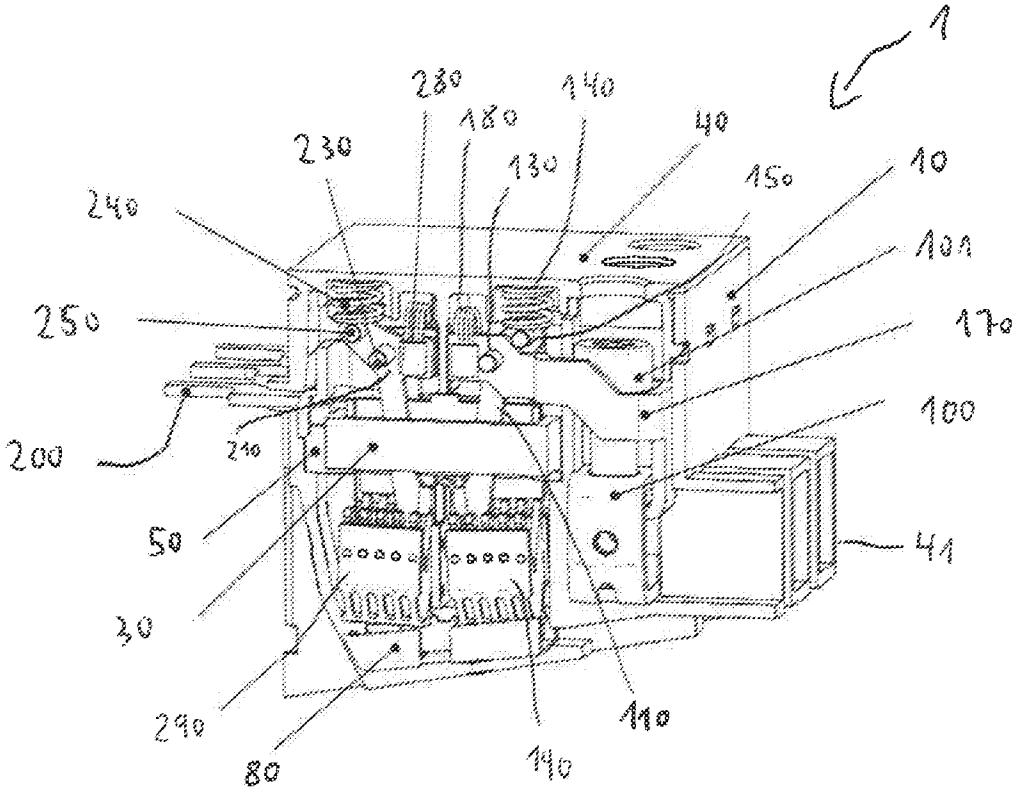
FIG. 1A is a sectional view of a first embodiment of a self-resetting current limiter.

An aspect of the present invention provides a self-resetting current limiter which makes it possible to safely interrupt a current path when a very high short-circuit current occurs in combination with a switching or basic device, the current limiter being immediately ready for operation again after the breaking operation.

In an embodiment, the present invention provides a self-resetting current limiter for interrupting a current path when a very high short-circuit current occurs in the current path, and for independently resetting the current limiter into the closed state after the short-circuit current has been switched off.

The self-resetting current limiter comprises a first connecting contact for bringing the current limiter into contact with a first electrical conductor, and a second connecting contact for bringing the current limiter into contact with a second electrical conductor. The self-resetting current limiter further comprises a first movable contact member and a second movable contact member.

The first and the second movable contact member are electrically interconnected in a particular first position, as a result of which a current path between the first and the second connecting contact is closed. The first and the second movable contact member are separated from one another in a particular second position of the first and the second movable contact member, as a result of which the current path between the first and the second connecting contact is interrupted.

As well as the first and the second movable contact member, the self-resetting current limiter has a contact system that can be opened by dynamic current forces. The movable part of the contact system is formed of two parts which consist of the first and the second movable contact member. Contacts, referred to as loose contacts, are arranged on the respective ends of the movable contact members, which contacts form the actual contact point via which the current flows between the two movable contact members in the closed state of the current path. Owing to the antiparallel current conduction, greater acceleration is generated at the loose contacts of the opening contact system, by means of which acceleration the two loose contacts are moved or spun away from one another.

In order to further increase the acceleration, a slot motor can be fitted in the housing of the current limiter.

In addition, a counter force can act on the first and the second movable contact member when they are spun on, which counter force is produced by a compression spring in each case. The compression spring assigned to the first and the second movable contact member acts on a lever arm of the first and the second movable contact member in each case. The arrangement consisting of movable contact members and the compression spring assigned to the particular contact member is designed such that the lever arm shortens as the spin-on path increases, such that a torque acting on the lever arm remains almost constant despite the increasing compression of the compression spring.

Greater acceleration of the movable contact members can be achieved by means of the compression spring which acts on each of the movable contact members, which spring does not allow its compression spring force to increase linearly when the movable contact members are spun on, but rather it shortens its lever arm as the spin-on path increases. The contact members therefore reach their end position quicker when they are moving apart from one another, as a result of which a high arc voltage can be generated more rapidly. As a result, even better short-circuit current limitation can be achieved. However, there is less torque acting in the compressed state of the compression spring owing to the shortened lever arm, meaning that the acceleration at which the movable contact members fall back into their starting position is reduced. As a result, the loose contacts can be prevented from being welded together after they have fallen back.

A first embodiment 1 of a self-resetting current limiter is described in more detail in the following with reference to FIGS. 1A, 1B and 2. The self-resetting current limiter 1 comprises a first connecting contact 100 for bringing the current limiter into contact with a first electrical conductor, for example the electrical conductor of a cable. In order to attach the electrical conductor to the connecting contact 100, the connecting contact 100 has a terminal screw 101. In addition, the current limiter 1 has a second connecting contact 200 for bringing the current limiter into contact with a second electrical conductor. The second electrical conductor can be, for example, a busbar of a switching device to which the current limiter is connected. The second connecting contact 200 can be designed in particular as a connecting bar, which is electrically connected to the busbar of the subsequent switching device. The switching device can be a circuit breaker, an automatic circuit breaker or a protective motor switch.

The self-resetting current limiter 1 further comprises a first movable contact member 110 and a second movable contact member 210. The first and the second movable contact member 110, 210 are arranged so as to be able to rotate about a particular rotary shaft 130, 230. The rotary shaft 130, 230 can be formed by a current bar 120, 220.

The self-resetting current limiter 1 further comprises a first stationary connector 170, which is electrically connected to the first connecting contact 100. A first flexible connecting member 180 of the self-resetting current limiter is arranged between the first stationary connector 170 and the first movable contact member 110. The first stationary connector 170 is electrically connected to the first movable contact member 110 by means of the first flexible connecting member 180.

The self-resetting current limiter 1 comprises a second stationary connector 270, which is electrically connected to the second connecting contact 200. In addition, the self-resetting current limiter 1 has a second flexible connecting member 280, which is arranged between the second stationary connector 270 and the second movable contact member 210. The second flexible connecting member 280 electrically connects the second stationary connector 270 to the second movable contact member 210. The first and the second flexible connecting member 180, 280 can have a solder cup 181, 281, which is arranged on one of the movable contact members 110, 210 in each case. The stationary connectors 170, 270 are each electrically connected to the movable contact members 110, 210 by means of an electrical stranded wire 182, 282 of the first and the second flexible connecting member 180, 280.

The self-resetting current limiter further comprises an electrically non-conductive housing 10, in which the first and the second connecting contact 100, 200, the first and the second movable contact member 110, 210, the connector 170, 270 and the connecting member 180, 280 are housed. The housing 10 is closed by a cover part 40. The housing 10 has an electrically non-conductive channel 41, which extends from outside the housing 10 to the first connecting contact 100. The channel 41 is formed as a bulge that projects from the side of the housing. The channel 41 is dimensioned such that or protrudes so far out of the housing 10 that the mode of connection of the current limiter meets the requirement of an increased air gap and leakage path according to the UL 489 Standard.

In order to produce a restoring force which acts on the first and the second movable contact member 110, 210 when said contact members are spun on, a first compression spring 140 and a second compression spring 240 are provided. The two compression springs are arranged in the cover part 40. The first compression spring 140 produces a restoring force on the first movable contact member when the first movable contact member 110 is spun on. The second compression spring 240 produces a restoring force on the second movable contact member when the second movable contact member 210 is spun on.

Figure 2:
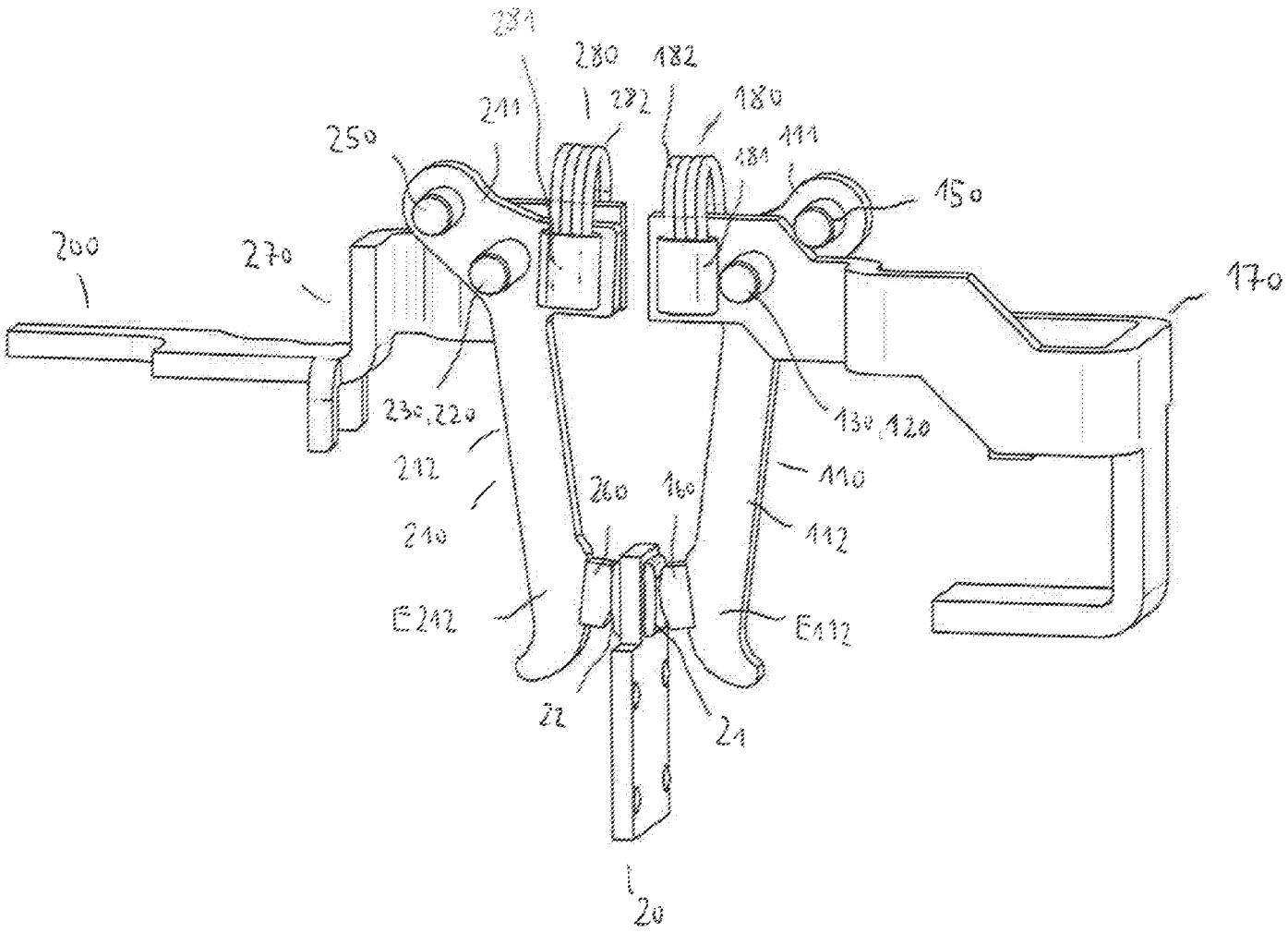
FIG. 2 shows components of the self-resetting current limiter for producing a current path in a closed state.

As can be seen in FIG. 2, the first movable contact member 110 has a first arm 111 comprising a support element 150 on which the first compression spring 140 rests in order to exert a force on the first arm 111 of the first movable contact member 110. The first arm 111 of the first movable contact member 110 extends from the support element 150 to the rotary shaft 130. The second movable contact member 210 has a first arm 211 comprising a support element 250 on which the second compression spring 240 rests in order to exert a force on the first arm 211 of the second movable contact member 210. The first arm 211 of the second movable contact member 210 extends from the support element 250 to the rotary shaft 230.

The first movable contact member 110 has a second arm 112, which extends from the rotary shaft 130 to an end portion E112 of the second arm 112 of the movable contact member 110. The first movable contact member 110 is bent along its longitudinal axis at the rotary shaft 130. The second arm 112 of the first movable contact member 110 is thus not arranged in the extension of the direction of the first arm 111 of the first movable contact member 110.

The second movable contact member 210 has a second arm 212, which extends from the rotary shaft 230 to an end portion E212 of the second arm 212 of the second movable contact member 210. The second movable contact member 210 is formed and arranged mirror-symmetrically with respect to the first movable contact member 110. In particular, the second arm 212 of the second movable contact member 210 is not arranged in the extension of the direction of the first arm 211 of the second movable contact member 210. The second movable contact member 210 is, rather, bent along its longitudinal axis in the region of the rotary shaft 230.

The self-resetting current limiter further comprises a first loose contact 160, which is arranged on the end portion E112 of the second arm 112 of the first movable contact member 110. A second loose contact 260 is likewise arranged on the end portion E212 of the second arm 212 of the second movable contact member 210.

Figure 1B:
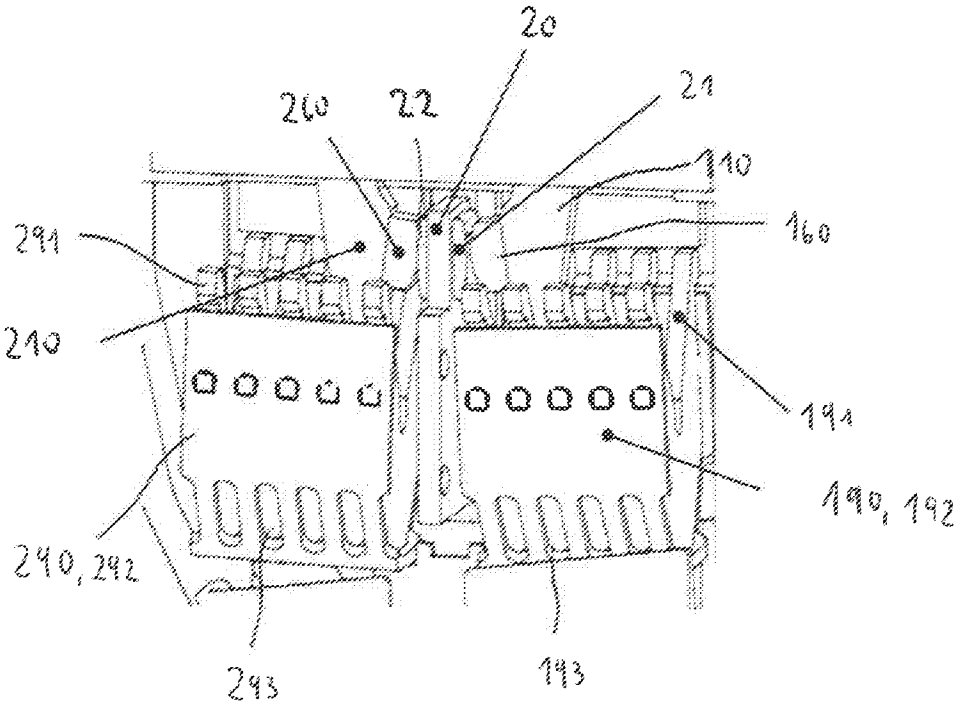
FIG. 1B is an enlarged view of a contact region between movable contact members of the self-resetting current limiter.

According to the embodiment of the self-resetting current limiter 1 shown in FIGS. 1A, 1B and 2, an adapter 20 is arranged between the end portion E112 of the second arm 112 of the first movable contact member 110 and the end portion E212 of the second arm 212 of the second movable contact member 210. The adapter 20 has a first fixed contact 21 and a second fixed contact 22. The first and the second fixed contact 21, 22 are arranged on an upper portion of the adapter. When the current path is closed during normal operation, the loose contact 160 is in contact with the fixed contact 21 and the loose contact 260 is in contact with the fixed contact 22. A lower portion of the adapter 20 is arranged between a first arc chute 190 and a second arc chute 290. Alternatively, instead of the separate arc chutes, only one arc chute can also be used, which extends along the length of the arc chutes 190 and 290.

FIG. 1B shows the adapter 20 having the fixed contacts 21 and 22 applied on either side and the lower portion of the adapter 20 arranged between the two arc chutes 190, 290. The arc chutes 190, 290 have a plurality of deion plates 191, 291, which are surrounded by a chute wall 192, 292. Blow-out openings 193, 293 are provided in the lower region of the chute wall 192, 292, through which openings breaking gases occurring during current flow are blown out into a blow-out channel 80 when the movable contact members 110, 210 are separated.

Figure 3A:
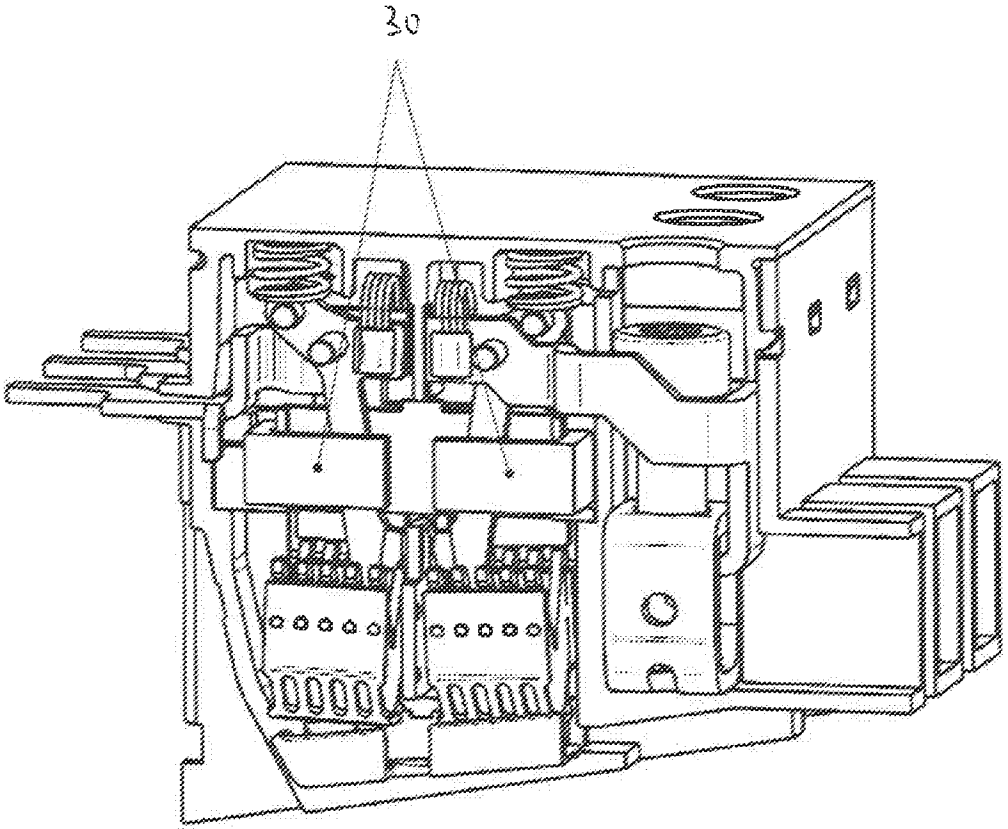
FIG. 3A is a self-resetting current limiter comprising a slot motor made of two U-shaped parts.

As is shown in the embodiment of the self-resetting current limiter in FIG. 1A, the current limiter can have a slot motor 30, which is arranged around the first and the second movable contact member 110, 210. According to the embodiment shown in FIG. 1A, the slot motor 30 can be designed as an annular or loop-shaped closed frame. In contrast to the slot motor shown in FIG. 1A as an integral, single part, the slot motor can comprise two U-shaped parts which are separated from one another by a gap, according to another embodiment shown in FIG. 3A. A material having good magnetic conductivity, for example iron, in particular a soft-iron material, can be used as the material for the slot motor.

Figure 3B:
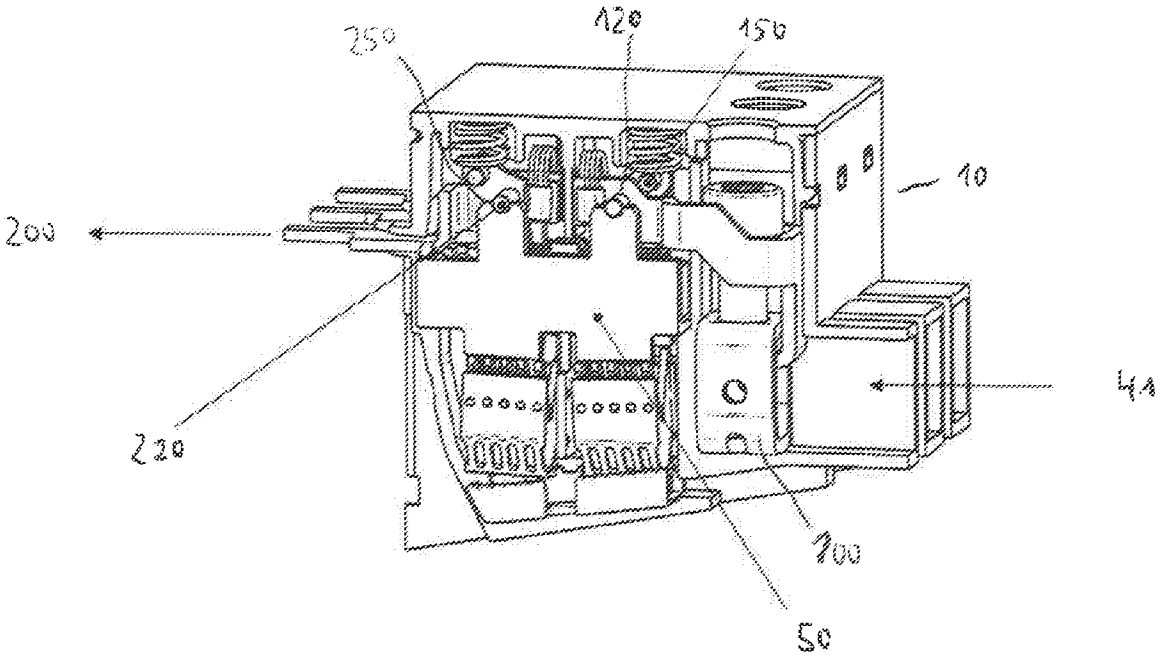
FIG. 3B is a self-resetting current limiter comprising an insulation cover for insulating the movable contact members with respect to the slot motor.

The slot motor made of an electrically conductive material can be insulated from the other conductive parts, in particular from the movable contact members 110, 210. The insulation cover 50 shown in FIG. 1A and FIG. 3B is provided for the purpose of said insulation. As can be seen in FIG. 3B, the insulation cover 50 can additionally be designed to guide the movable contact members 110, 210 and to mount said members over the current bars 120, 220.

Figure 4:
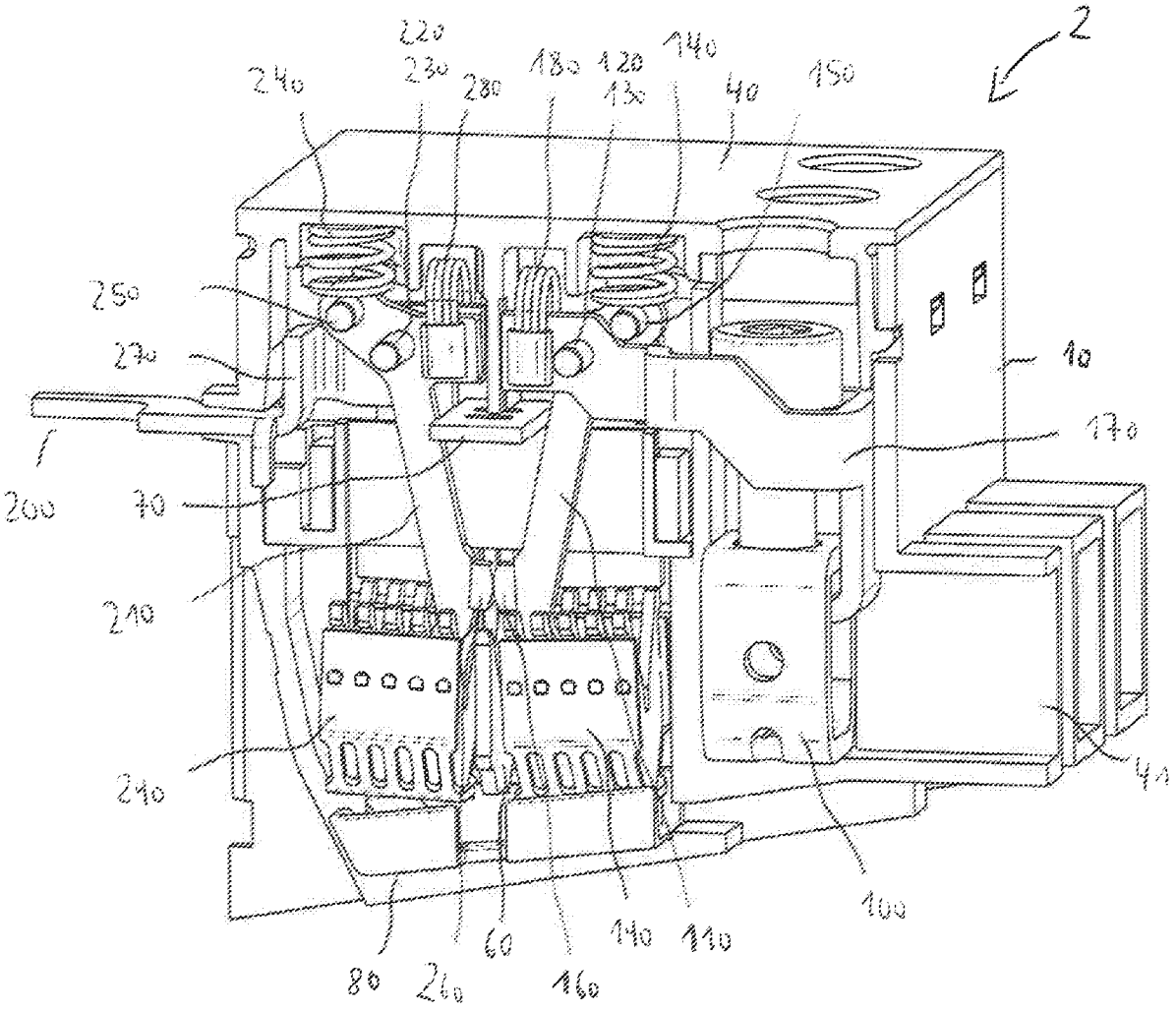
FIG. 4 is a first perspective view of a second embodiment of a self-resetting current limiter.

FIG. 4 shows a second embodiment 2 of a self-resetting current limiter. In the following, only the differences from the first embodiment 1 will be described. In contrast to the first embodiment 1 of the self-resetting current limiter, in the second embodiment 2, an additional deion plate 60 is provided between the first arc chute 190 and the second arc chute 290, rather than the adapter 20. According to an alternative embodiment, the arc chutes 190, 290 and the deion plate 60 can be consolidated to form a single or common arc chute. The deion plate 60 does not extend between the two movable contact members 110, 210 as the adapter 20 does. Instead, the loose contacts 160, 260 of the movable contact members 110, 210 are in direct contact with one another when the current limiter is operated in normal operation, i.e. not in the event of a short circuit, and the current path is closed.

In order to position the two movable contact members 110 and 210, when they fall back in a non-uniform manner after the opening process, a contact member stop 70 is provided. The two movable contact members 110 and 210 are not normally in contact with the contact member stop 70. However, one of the movable contact members can hit the contact member stop 70 when it falls back into the starting position if, for example, the contact member falls back into the starting position more rapidly than the opposite contact member, or the material of the loose contact is burnt off for one of the contact members. The contact member stop 70 is thus to be understood as an auxiliary stop which limits the maximum movement of the contact member 110 or 210 when it falls back into the starting position, resulting in ideal contact covering. In addition, the contact member stop 70 prevents the movable contact members 110 and 210 from welding together when the loose contacts 160 and 260 are burnt off. In addition, the contact member stop 70 functions such that the breaking gases do not spread towards the flexible connecting members 180 or 280, meaning that flashbacks in this region can be effectively prevented.

Figure 5A:
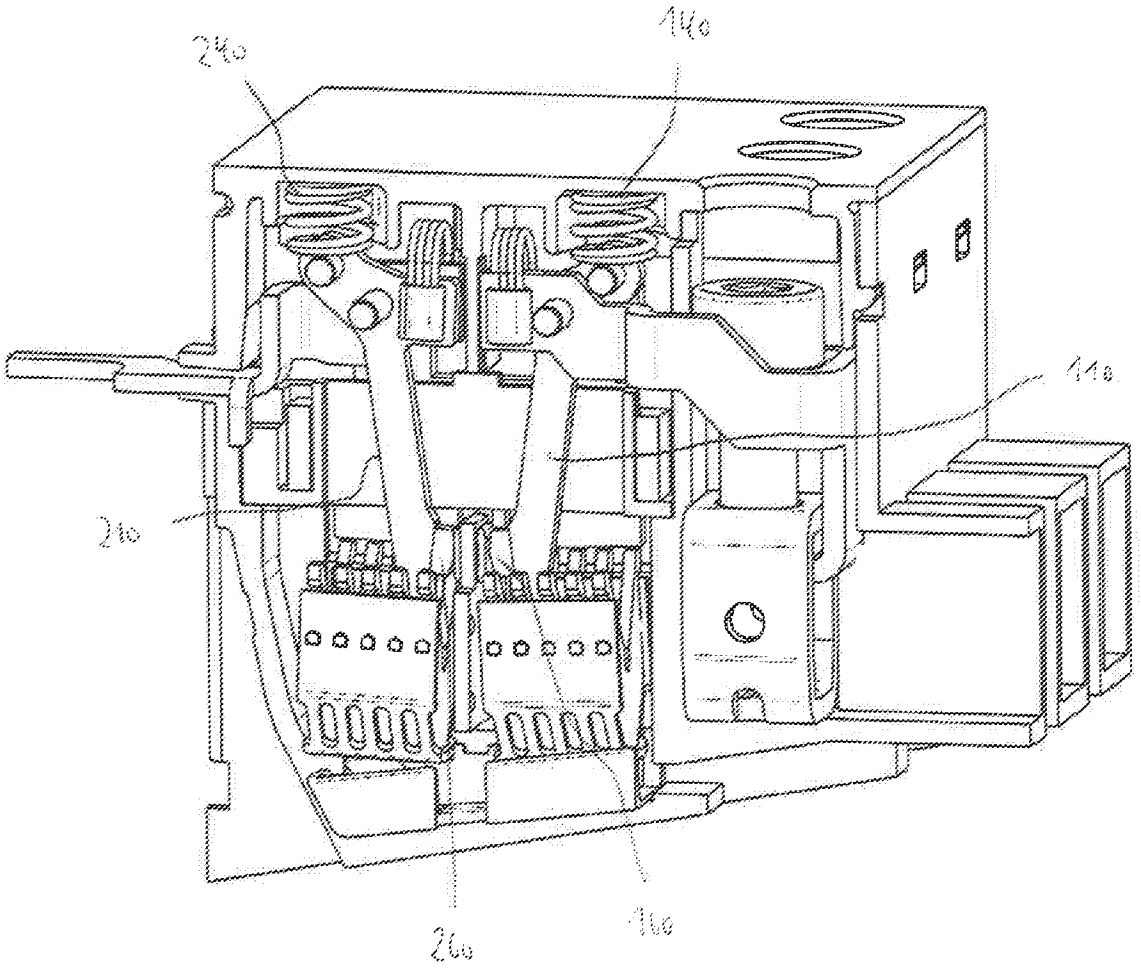
FIG. 5A is a self-resetting current limiter having movable contact members in a first position.

FIG. 5A shows the self-resetting current limiter according to the first embodiment 1 in a normal state of operation, when no short-circuit current is flowing. The movable contact members 110, 210 are electrically interconnected in a particular first position of the two contact members, as a result of which a current path between the first connecting contact 100 and the second connecting contact 200 is closed. The loose contact 160, in the first position of the movable contact member 110, is in contact with the first fixed contact 21. The loose contact 260, in the first position of the movable contact member 210, is in contact with the second fixed contact 22. In normal operation, a current can thus flow from the connecting contact 100 via the stationary connector 170 and the flexible connecting member 180 to the movable contact member 110 and also via the adapter 20, the movable contact member 210, the flexible connecting member 280 and the stationary connector 270 to the connecting contact 200.

When a short-circuit current occurs between the connecting contact 100 and the connecting contact 200, a force caused by the short-circuit current acts on the first movable contact member 110. A force caused by the short-circuit current likewise acts on the second movable contact member 210. Owing to the action of force, the movable contact members 110 and 210 are rotated or spun on into the second position. In the second position, the ends of the contact members 110 and 210 hit the inner wall of the housing body 10. The compression spring 140 exerts, on the first movable contact member 110, a counter force with respect to the force caused by the short-circuit current when the first movable contact member 110 is spun on. The compression spring 240 likewise exerts, on the second movable contact member 210, a counter force with respect to the force caused by the short-circuit current when the second movable contact member 210 is spun on.

The counter forces exerted by the two compression springs 140, 240 on the respective movable contact members 110, 210 cause the acceleration at the movable contact members 110 and 210 to reduce. Therefore, the increase in counter force is as small as possible, and it is thus ensured that the loose contacts 160 and 260 can be very quickly spun away from one another. In order to exert the counter force on the movable contact member 110, the compression spring 140 is supported on the support element 150, which can be formed as a straight pin 151. The compression spring 240 is supported on the support element 250, which can also be formed as a straight pin 251.

Figure 5B:
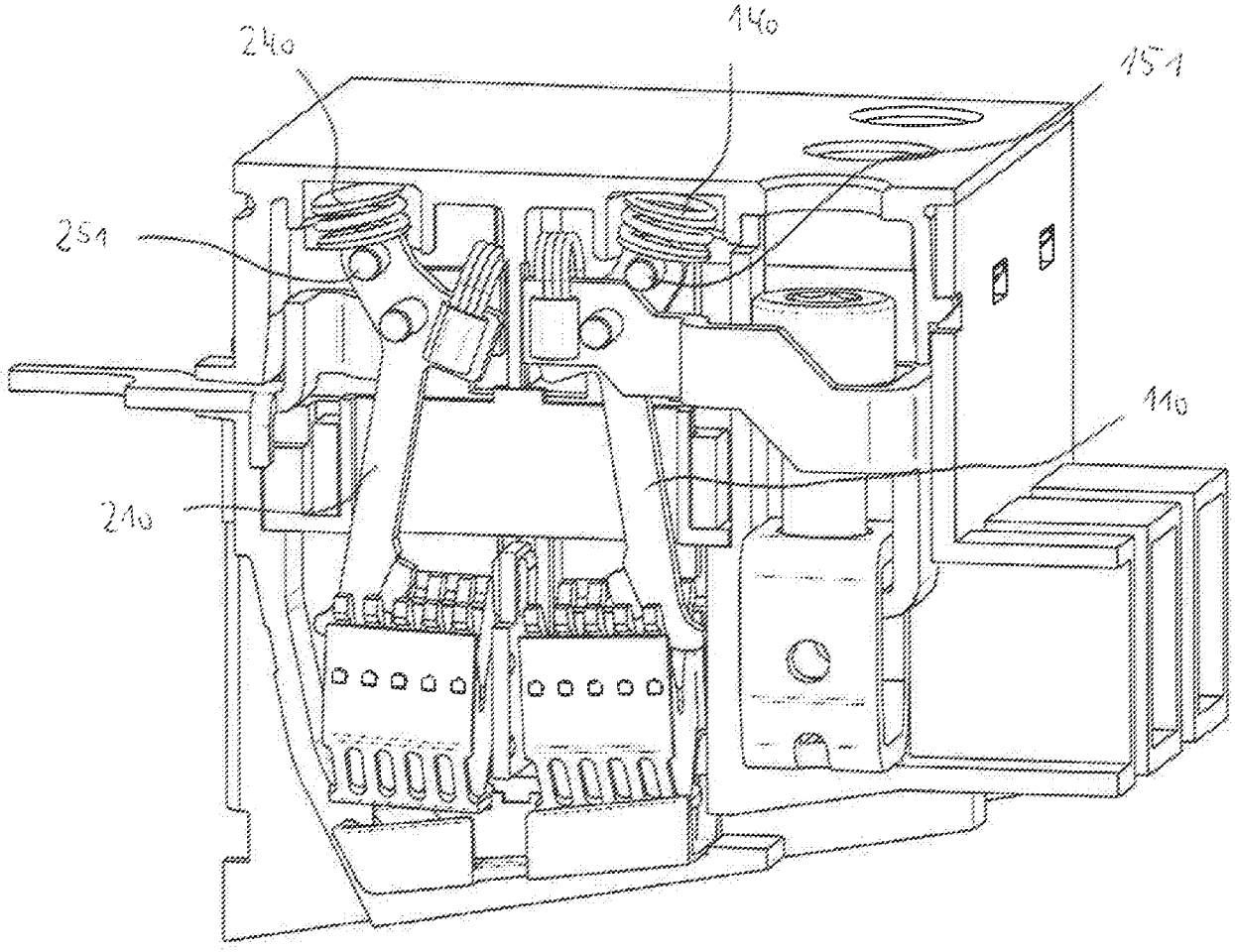
FIG. 5B is a self-resetting current limiter having movable contact members in a second position.

FIG. 5B shows the self-resetting current limiter when a short-circuit current occurs in the current path. The two movable contact members 110, 210 are spun on due to the high current and are temporarily located in a second position in which they are insulated from one another. The current path is thus interrupted between the connecting contacts 100 and 200. The forces exerted on the support elements 150 and 250 by the compression springs 140 and 240 cause the movable contact members 110 and 210 to fall back into their starting position (shown in FIG. 5A) after having been spun on and after the short-circuit current has been switched off by the switching or basic device. The circuit can thus be switched on again ("self-resetting current limiter") by actuating the switching or basic device, without additionally actuating the current limiter.

When a short-circuit current occurs, forces are generated in the region of the connection points of the two movable contact members 110 and 210, which forces push the two movable contact members away from one another or away from the adapter 20. Forces of this kind are known as current density forces or Holm forces and occur at constrictions of current paths. Current density forces are Lorentz forces which are formed on either side of a constriction of a current path owing to currents running in opposing directions.

The contact system is constructed such that the short-circuit currents flowing in the two movable contact members 110 and 210 are in opposite directions and thus also move or spin the moving contact members 110, 210 away from one another. As can be seen in FIG. 5B, the two movable contact members 110, 210 are rotated or spun about their particular rotary shaft 130, 230 when a short-circuit current occurs in the current path between the connecting contacts 100 and 200. The flexible connecting members 180, 280 and in particular the electrical stranded wires 182, 282 make it possible for the two rotatably mounted and movable contact members 110, 210 to be able to twist against the stationary connectors 170, 270.

The slot motor 30 causes the magnetic field to extend to the contact members 110 and 210, which, on account of the Lorentz force, leads to an increase in the force acting on the movable contact members 110, 210 and thus accelerates the movable contact members 110, 210 even more in their spin-on movement. The arc between the loose contacts 160, 260, which is produced when the two movable contact members 110, 210 move away from one another, damps the short circuit.

The mode of operation of the second embodiment 2 of the self-resetting current limiter according to FIG. 4 corresponds to the mode of operation shown in FIGS. 5A and 5B for the first embodiment 1 of the self-resetting current limiter, in this case, however, the loose contact 160 and the loose contact 260 being in direct contact with one another in the first position of the movable contact members 110, 210.

Figure 6:
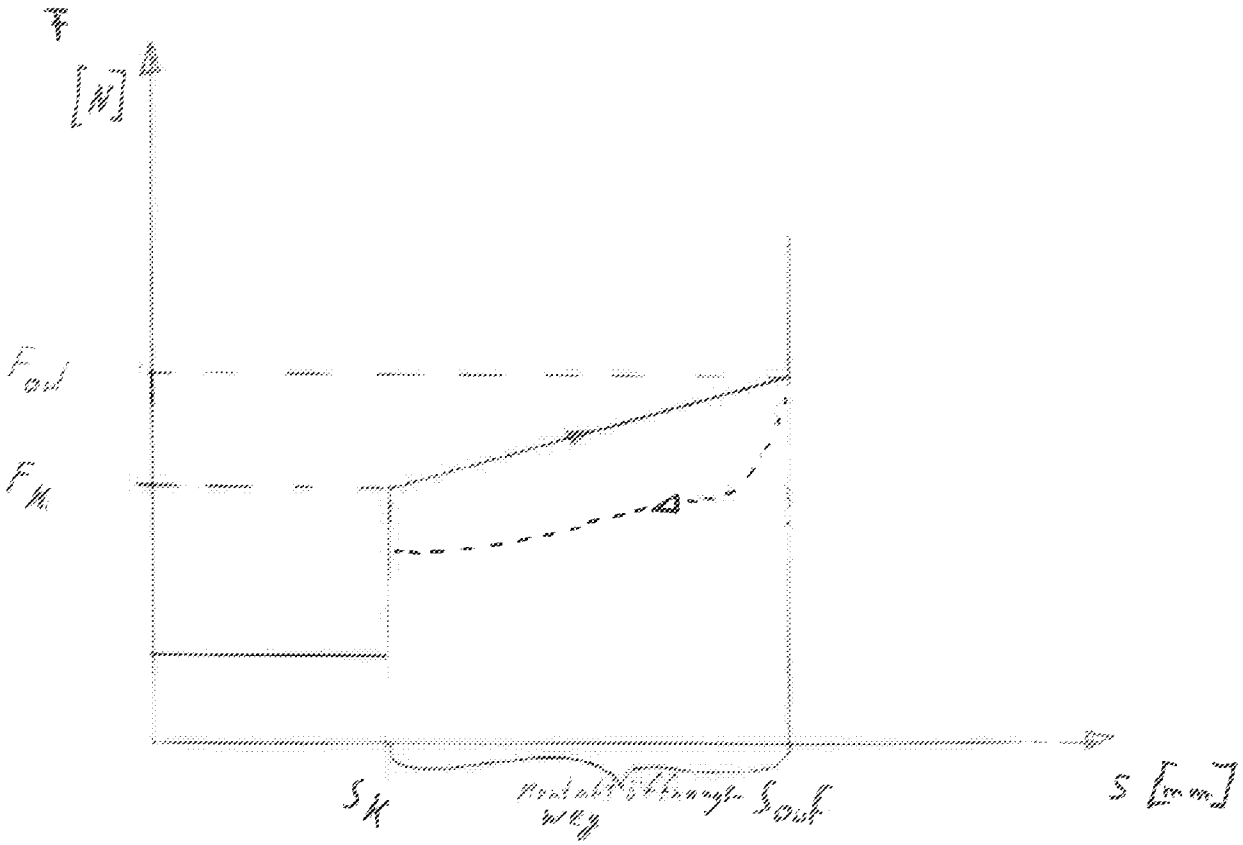
FIG. 6 shows a contact force-distance characteristic curve of the self-resetting current limiter.

FIG. 6 shows a contact force-distance characteristic curve for the self-resetting current limiter. The arm 111 of the movable contact member 110 is oriented with respect to the arm 112 of the movable contact member 110 such that a contact force F acting perpendicularly on the surface of the loose contact 160 increases linearly from a strength $F_k$ initially up to a strength $F_{auf}$ when the first movable contact member 110 is moved from the first position $s_K$ into the second position $S_{auf}$. The arm 211 of the second movable contact member 210 is likewise oriented with respect to the arm 212 of the second movable contact member 210 such that a contact force F acting perpendicularly on the surface of the loose contact 260 increases linearly starting from a strength $F_k$ up to a strength $F_{auf}$ when the second movable contact member 210 is moved from the first position $S_K$ into the second position $S_{auf}$.

In addition, the arm 111 is oriented with respect to the arm 112 of the first movable contact member 110 such that a contact force F acting perpendicularly on the surface of the loose contact 160 decreases non-linearly from the strength $F_{auf}$ down to the strength $F_k$ when the first movable contact member 110 is moved from the second position $S_{auf}$ into the first position $S_k$. The arm 211 is likewise oriented with respect to the arm 212 of the second movable contact member 210 such that the contact force F acting perpendicularly on the surface of the loose contact 260 decreases non-linearly from the strength $F_{auf}$ down to the strength $F_k$ when the second movable contact member 210 is moved from the second position $S_{auf}$ into the first position $s_k$. The contact force decreases first quicker then slower per length of path. The speed when the two movable contact members 110 and 210 fall back can thus be reduced, as a result of which the loose contacts 160 and 260 are prevented from welding together when the current path closes, i.e. when the current limiter is reset.

Figure 7B:
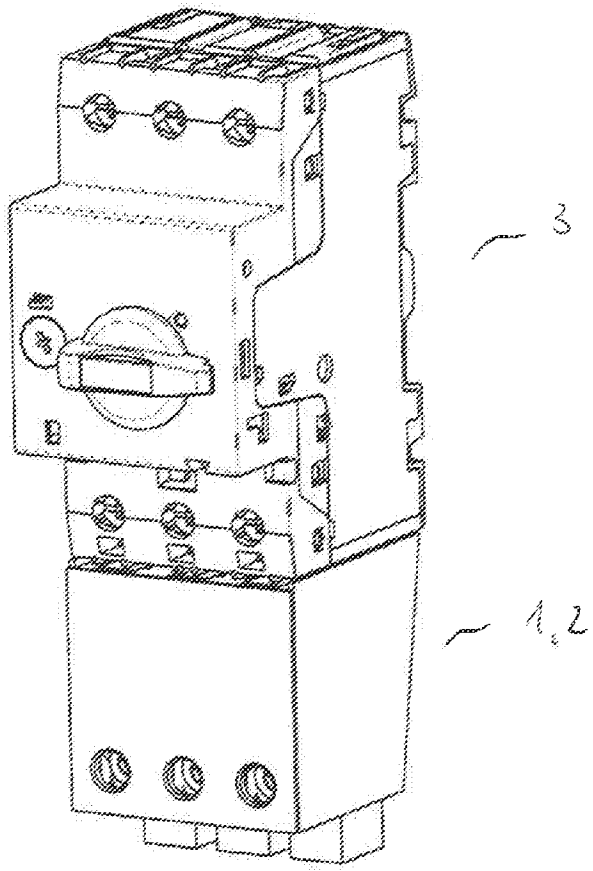
FIG. 7B is a second arrangement of a self-resetting current limiter and a switching device.
Figure 7A:
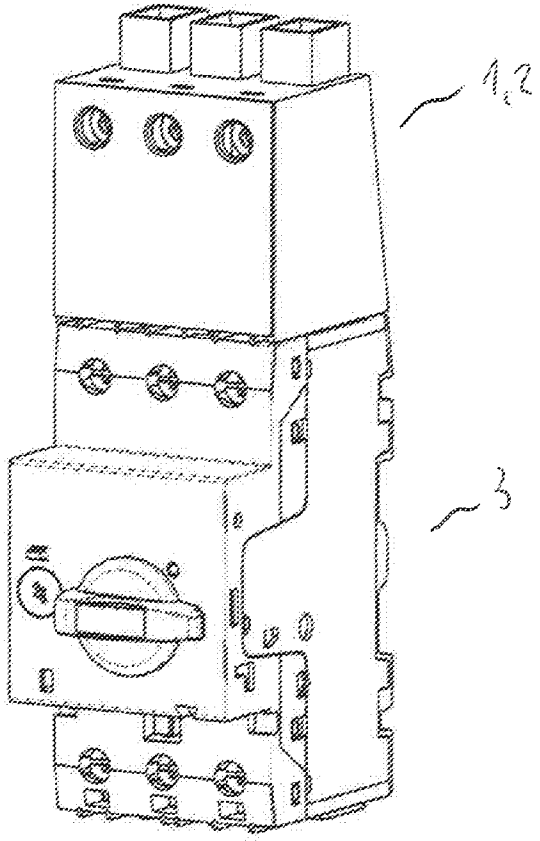
FIG. 7A is a first arrangement of a self-resetting current limiter and a switching device.

FIGS. 7A and 7B show different arrangements of the self-resetting current limiter in the first or second embodiment 1, 2 and a switching device 3. The self-resetting current limiter can be arranged on the top of the switching device 3, as shown in FIG. 7A, or on the bottom of the switching device 3, as shown in FIG. 7B.

The self-resetting current limiter 1, 2 assists the switching device 3, which is designed for example as a circuit breaker, an automatic circuit breaker or a protective motor switch, in switching off a short-circuit current. The magnetic quick-release and the mechanical latch of a switching device cause the contact apparatus to open permanently, while the movable contact members or repulsion contacts of the self-resetting current limiter 1, 2 fall back into their closed rest position independently. The self-resetting current limiter is thus ready for operation again without additional manual actuation or remote control.

The current limiter can be designed for one, two or even three poles. Depending on the number of poles, a plurality of the described components of the current limiter is arranged in the housing 10. The number of channels or feeders 41 leading to the connecting contact 100 likewise increases.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1, 2 self-resetting current limiter
10 housing
20 adapter
21, 22 fixed contact
30 slot motor
40 cover part
41 channel/bulge
50 insulation cover
60 deion plate
70 contact member stop
80 blow-out channel
100, 200 connecting contact
110, 210 movable contact member
120, 220 current bar
130, 230 rotary shaft
140, 240 compression spring
150, 250 support element
151, 251 straight pin
160, 260 loose contact
170, 270 stationary connector
180, 280 flexible connecting member
190, 290 arc chute

The invention claimed is:

1. A self-resetting current limiter, comprising:

a first connecting contact configured to bring the current limiter into contact with a first electrical conductor;

a second connecting contact configured to bring the current limiter into contact with a second electrical conductor;

a first movable contact member;

a second movable contact member; and a first compression spring and a second compression spring, wherein the first and the second movable contact members are electrically interconnected in a first position of the first and the second movable contact member, such that a current path between the first and the second connecting contact is closed, and wherein the first and the second movable contact members are separated from one another in a second position of the first and the second movable contact member, such that the current path between the first and the second connecting contact is interrupted, wherein, when a short-circuit current occurs between the first and the second connecting contacts, a force caused by the short-circuit current acts on the first movable contact member and a force caused by the short-circuit current acts on the second movable contact member, by which forces the first and the second movable contact members are spun into the second position, wherein the first compression spring is configured to exert, on the first movable contact member, a counter force with respect to the force caused by the short-circuit current when the first movable contact member is spun, wherein the second compression spring is configured to exert, on the second movable contact member, a counter force with respect to the force caused by the short-circuit current when the second movable contact member is spun, wherein the first movable contact member has a first arm comprising a support element configured to support the first compression spring on the first arm of the first movable contact member, wherein the first arm of the first movable contact member extends from the support element of the first arm of the first movable contact member to a rotary shaft of the first movable contact member, wherein the second movable contact member has a first arm comprising a support element configured to support the second compression spring on the first arm of the second movable contact member, wherein the first arm of the second movable contact member extends from the support element of the second movable contact member to a rotary shaft of the second movable contact member, wherein the first movable contact member has a second arm, which extends from the rotary shaft of the first movable contact member, wherein the second arm of the first movable contact member is not arranged in an extension of a direction of the first arm of the first movable contact member, wherein the second movable contact member has a second arm, which extends from the rotary shaft of the second movable contact member, and wherein the second arm of the second movable contact member is not arranged in an extension of a direction of the first arm of the second movable contact member.

2. The self-resetting current limiter according to claim 1, further comprising:

a first loose contact, which is arranged on an end portion of the second arm of the first movable contact member, and a second loose contact, which is arranged on an end portion of the second arm of the second movable contact member.

3. The self-resetting current limiter according to claim 2, wherein the first arm of the first movable contact member is oriented with respect to the second arm of the first movable contact member such that a contact force acting perpendicularly on a surface of the first loose contact increases linearly when the first movable contact member is moved from the first position into the second position, and wherein the first arm of the second movable contact member is oriented with respect to the second arm of the second movable contact member such that a contact force acting perpendicularly on a surface of the second loose contact increases linearly when the second movable contact member is moved from the first position into the second position.

4. The self-resetting current limiter according to claim 2, wherein the first arm of the first movable contact member is oriented with respect to the second arm of the first movable contact member such that a contact force acting perpendicularly on a surface of the first loose contact decreases non-linearly when the first movable contact member is moved from the second position into the first position, and wherein the first arm of the second movable contact member is oriented with respect to the second arm of the second movable contact member such that a contact force acting perpendicularly on a surface of the second loose contact decreases non-linearly when the second movable contact member is moved from the second position into the first position.

5. The self-resetting current limiter according to claim 2, further comprising:

an adapter arranged between the end portion of the second arm of the first movable contact member and the end portion of the second arm of the second movable contact member, wherein the adapter has a first fixed contact and a second fixed contact, wherein the first loose contact, in the first position of the first movable contact member, is in contact with the first fixed contact, and wherein the second loose contact, in the first position of the second movable contact member, is in contact with the second fixed contact.

6. The self-resetting current limiter according to claim 2, wherein the first loose contact and the second loose contact, in the first position of the first and the second movable contact members, are in direct contact with one another.

7. A self-resetting current limiter, comprising:

a first connecting contact configured to bring the current limiter into contact with a first electrical conductor;

a second connecting contact configured to bring the current limiter into contact with a second electrical conductor;

a first movable contact member;

a second movable contact member; and a first compression spring and a second compression spring, wherein the first and the second movable contact members are electrically interconnected in a first position of the first and the second movable contact member, such that a current path between the first and the second connecting contact is closed, wherein the first and the second movable contact members are electrically separated from one another in a second position of the first and the second movable contact member, such that the current path between the first and the second connecting contact is interrupted, wherein the first movable contact member and the second movable contact member are movable independent of one another, wherein, when a short-circuit current occurs between the first and the second connecting contacts, a force caused by the short-circuit current acts on the first movable contact member and a force caused by the short-circuit current acts on the second movable contact member, by which forces the first and the second movable contact members are spun into the second position, wherein the first compression spring is configured to exert, on the first movable contact member, a counter force with respect to the force caused by the short-circuit current when the first movable contact member is spun, wherein the second compression spring is configured to exert, on the second movable contact member, a counter force with respect to the force caused by the short-circuit current when the second movable contact member is spun, wherein the first movable contact member has a first arm comprising a support element configured to support the first compression spring on the first arm of the first movable contact member, wherein the first arm of the first movable contact member extends from the support element of the first arm of the first movable contact member to a rotary shaft of the first movable contact member, wherein the second movable contact member has a first arm comprising a support element configured to support the second compression spring on the first arm of the second movable contact member, and wherein the first arm of the second movable contact member extends from the support element of the second movable contact member to a rotary shaft of the second movable contact member.

8. The self-resetting current limiter according to claim 7, wherein the first and the second movable contact members are arranged so as to be able to rotate about a rotary shaft.

9. The self-resetting current limiter according to claim 8, wherein the first and the second movable contact members are configured to be spun about the rotary shaft when a short-circuit current occurs in the current path between the first and the second connecting contacts.

10. The self-resetting current limiter according to claim 7, further comprising:

a first compression spring and a second compression spring, wherein, when a short-circuit current occurs between the first and the second connecting contacts, a force caused by the short-circuit current acts on the first movable contact member and a force caused by the short-circuit current acts on the second movable contact member, by which forces the first and the second movable contact members are spun into the second position, wherein the first compression spring is configured to exert, on the first movable contact member, a counter force with respect to the force caused by the short-circuit current when the first movable contact member is spun, wherein the second compression spring is configured to exert, on the second movable contact member, a counter force with respect to the force caused by the short-circuit current when the second movable contact member is spun.

11. The self-resetting current limiter according to claim 7, further comprising:

a slot motor arranged around the first and the second movable contact members.

12. The self-resetting current limiter according to claim 7, further comprising:

a first stationary connector, which is electrically connected to the first connecting contact;

a first flexible connecting member, which is arranged between the first stationary connector and the first movable contact member and electrically connects the first stationary connector to the first movable contact member;

a second stationary connector, which is electrically connected to the second connecting contact; and a second flexible connecting member, which is arranged between the second stationary connector and the second movable contact member and electrically connects the second stationary connector to the second movable contact member.

13. The self-resetting current limiter according to claim 7, further comprising:

an electrically non-conductive housing, in which the first and the second connecting contacts and the first and the second movable contact members are housed, wherein the housing has an electrically non-conductive channel, which extends from outside the housing to the first connecting contact.

* * * * *